United States Patent [19]

Kusov et al.

[11] Patent Number: 4,864,933

[45] Date of Patent: Sep. 12, 1989

[54] METHOD OF ROCK BREAKAGE BY BLASTING

[75] Inventors: Nikolai F. Kusov; Valentin I. Pshenichny, both of Ljubertsy Moskovskaya; Revaz A. Chakvetadze, Tkubuli; Gennady Y. Krekker, Pavlo-darskaya, all of U.S.S.R.

[73] Assignee: Institut Gornogo Dela Imeni A.A. Skochinskogo, Moscow, U.S.S.R.

[21] Appl. No.: 218,657

[22] Filed: Jul. 13, 1988

[51] Int. Cl.[4] ..... F42B 3/00

[52] U.S. Cl. ..... 102/312; 102/313; 299/13

[58] Field of Search ..... 102/312, 313; 299/13

[56] References Cited

U.S. PATENT DOCUMENTS

| | | | |
|---|---|---|---|
| 4,513,665 | 4/1985 | Ricketts et al. | 102/312 |
| 4,585,496 | 4/1986 | Honeyman et al. | 102/313 X |
| 4,586,438 | 5/1986 | Coursen et al. | 102/313 X |
| 4,614,146 | 9/1986 | Ross et al. | 102/313 X |
| 4,736,683 | 4/1988 | Bachman et al. | 102/290 |
| 4,764,231 | 8/1988 | Slawinski et al. | 102/313 X |

*Primary Examiner*—Peter A. Nelson

*Attorney, Agent, or Firm*—Burgess, Ryan & Wayne

[57] ABSTRACT

The method of breaking rock by blasting comprises drilling of boreholes, loading of a blasting charge with a means of initiation therein and stemming. The stemming is made up of a phlegmatized low-velocity explosive.

1 Claim, No Drawings

METHOD OF ROCK BREAKAGE BY BLASTING

FIELD OF THE INVENTION

The present invention relates to the mining industry, and more particularly it relates to methods of breaking rock by blasting.

The proposed method can find most efficient application in breaking rock in open pits and quarries by blasting using borehole blasting charges.

The capacity of loading and handling machinery is largely determined by the degree of rock breakage through blasting and by the compact form of blasted rock mass. It is, therefore, fairly important to increase blasting efficiency. Among a large number of factors responsible for higher blasting efficiency much importance is attached to borehole stemming, which promotes the effective transfer of energy to surrounding rock mass.

DESCRIPTION OF THE PRIOR ART

There is known a method of breaking rock by blasting, which comprises drilling of boreholes, loading of a blasting charge with a means of initiation therein and stemming (cf. "Blasting Operations" by B. N. Kutuzov 1980, Nedra Publishers, Moscow, pp. 236, 237). The stemming comprises some 2–5 kg of blasting charges.

With the stemming located in the upper portion of a borehole, the amount of useful blasting energy expended in breaking of the upper part of the bank mostly responsible for oversize yield is fairly small. What is more, with the stemming like this, it is impossible to effectively transfer the blasting energy to break the rock mass because the effect of detonation products on the borehole walls takes place within a comparatively short period of time.

OBJECTS AND SUMMARY OF THE INVENTION

It is an object of the present invention to provide maximum safety in breaking rock by blasting.

It is another object of the present invention to provide a lower oversize yield by damping the explosive pulse regularly.

It is a further object of the present invention to provide a compact form of blasted rock mass.

These and other objects are attained due to the fact that in a method of breaking rock by blasting, which comprises drilling of boreholes, loading of a blasting charge with a means of initiation therein and stemming, according to the invention, the stemming is made up of a phlegmatized low-velocity explosive.

The use of the stemming as a phlegmatized blasting agent featuring low detonation susceptibility and rate with a controlled critical blast damping length makes it possible to control the specific impulse transmitted to the lateral borehole surface in the upper part of the bank, which in turn enables the breaking process to be controlled.

The amount of the aggregate momentum transferred by a blasting charge to the lateral borehole surface with the use of stemming is comparable to that in the upper part of the bank within the portion of the detonation stemming and reaches 0.7 of the amount of the charge aggregate momentum.

Taking into account the interaction between the shock wave and the rarefaction wave of the primary charge, on the one hand, and the waves set up in the process of damped detonation and stemming combustion, on the other hand, it is expedient that the stemming length exceed the critical blast damping length with a phlegmatized explosive used.

For stemming, ammonium nitrate phlegmatized with some 10–15 percent of water is preferably used.

This will enable one to control the critical blast damping length and release additional energy to break the areas most likely responsible for oversize yield.

The use of the method of breaking rock by blasting, according to the invention makes it possible to dramatically increase rock breaking efficiency using borehole blasting charges, provide high reliability of blasting, eliminate hand labour in damping the charge into holes, and mechanize this process following the use of a charging machine. Besides, with the stemming used, it is possible, according to the invention, to increase both blasting time and range to cover the whole rock mass and in particular its upper portion mostly responsible for oversize yield in the event of blasting operations.

BRIEF DESCRIPTION OF THE EMBODIMENT

The method of breaking rock by blasting is carried into effect as follows.

An appropriate number of boreholes are drilled in rock to be broken. A blasting charge with a means of initiation is loaded in each borehole. For stemming, use is made of a phlegmatized low-velocity blasting agent, say, dry ammonium nitrate.

The stemming length exceeds the critical blast damping length.

Theoretically, the stemming length is calculated with the following formula:

$$1 = 0.5 + \frac{D_2 \cdot l_1}{D_1 - D_2},$$

where $l_1$ is a borehole blasting charge length between primers, m;

$D_1$ is a borehole blasting charge detonation rate, m/s;

$D_2$ is an average stemming ammonum nitrate detonation rate—1,100 m/s.

The experiments have made it possible to control the critical blast damping length by phlegmatizing the stemming with water in different quantities. It has been found that when using blasting agents with a detonation rate below 4,000 m/s the ammonium nitrate stemming should be advisably phlegmatized with 10 percent of water, whereas in the event of a detonation rate exceeding 4,000 m/s, with 15 percent of water.

In the event of the stemmed blasting charges, according to the invention the explosion products, as shown frame-wise in the film, start to burst out of the boreholes approximately 50–60 ms after borehole charge initiation, i.e. with the proposed stemming the effect of detonation products on the rock mass lasts about three times longer than that when using known (inert) stemmings.

EXAMPLE

A blasting charge 7 m long was loaded in a borehole 14 m deep and 250 mm in diameter. Grammonite was used as a blasting agent. Double initiation was carried out. Blasting charge detonation rate $D_1$=4,200 m/s. Average stemming detonation rate $D_2$=1,100 m/s. Stemming length l=3 m. Ammonium nitrate phlegmatized with 15 percent of water by weight was used for stemming.

The main criterion for assessing the rock breaking efficiency through blasting, according to the hereinproposed method, was grain composition determined by photoplanimetry with measuring each particular lump (oversize) and the width of blasted rock mass.

According to the blasting results, the rock was evenly broken along the full vertical extent of the bank, the yield of large fractions in excess of 400 mm in size decreased between one- and twofold, the yield of oversize decreased threefold and over, and the width of the blasted rock mass of a relatively compact form was reduced by 6 m as compared with the prototype.

What is claimed is:

1. Method of breaking rock by blasting, comprising the steps of:

drilling boreholes;

loading blasting charges of a primary explosive in a lower portion of said boreholes together with an initiation means;

locating a stemming in an upper portion of said boreholes, said stemming being made out of a phlegmatized explosive having a lower velocity of detonation than that of said blasting charges of the primary explosive;

forming said stemming so that its length exceeds a critical blast damping length of said phlegmatized explosive and is calculated in accordance with the following formula:

$$L = 0.5 + \frac{D2 \cdot 1}{D1 - D2},$$

wherein:

L is the length of the stemming (in m), l is the length of the explosive charge in the borehole between the initiation means (in m), D1 is the velocity of detonation in the borehole explosive charge (in m/sec), and D2 is the mean velocity of detonation in the stemming (in m/sec).

* * * * *